US008627581B2

(12) United States Patent
Brown

(10) Patent No.: US 8,627,581 B2
(45) Date of Patent: Jan. 14, 2014

(54) HEAT DELIVERY SYSTEM FOR A FABRIC CARE APPLIANCE

(76) Inventor: Michael E. Brown, Orlando, FL (US)

( * ) Notice: Subject to any disclaimer, the term of this patent is extended or adjusted under 35 U.S.C. 154(b) by 518 days.

(21) Appl. No.: 12/674,824

(22) PCT Filed: Aug. 25, 2008

(86) PCT No.: PCT/US2008/074266

§ 371 (c)(1),
(2), (4) Date: Jan. 18, 2011

(87) PCT Pub. No.: WO2009/026591

PCT Pub. Date: Feb. 26, 2009

(65) Prior Publication Data

US 2011/0099834 A1 May 5, 2011

Related U.S. Application Data

(60) Provisional application No. 60/957,677, filed on Aug. 23, 2007.

(51) Int. Cl.
*F26B 11/02* (2006.01)

(52) U.S. Cl.
USPC ..... 34/603; 34/607; 68/19; 8/159

(58) Field of Classification Search
CPC ..... D06F 58/10; D06F 58/14
USPC ..... 34/79, 132, 595, 603, 606, 607; 68/5 C, 68/5 R, 19, 20; 8/137, 149, 159
See application file for complete search history.

(56) References Cited

U.S. PATENT DOCUMENTS

| | | | | |
|---|---|---|---|---|
| 2,397,091 | A | 3/1946 | Davis | |
| 3,318,017 | A * | 5/1967 | Smith, Jr. | 34/114 |
| 3,491,456 | A * | 1/1970 | Candor et al. | 34/251 |
| 3,699,664 | A | 10/1972 | Lunsford | |
| 3,912,002 | A | 10/1975 | Elliott | |
| 4,143,642 | A | 3/1979 | Beaulieu | |
| 4,429,661 | A | 2/1984 | McClure | |
| 4,514,914 | A | 5/1985 | Kitzmiller | |
| 4,520,577 | A | 6/1985 | Suissa | |
| 4,603,489 | A | 8/1986 | Goldberg | |
| 4,621,438 | A | 11/1986 | Lanciaux | |

(Continued)

FOREIGN PATENT DOCUMENTS

| | | | | |
|---|---|---|---|---|
| DE | 3832632 A1 * | 4/1990 | | F26B 3/16 |
| JP | 58163499 A * | 9/1983 | | C02F 11/12 |

(Continued)

*Primary Examiner* — Steve M Gravini
(74) *Attorney, Agent, or Firm* — R. Randall Frisk

(57) ABSTRACT

A drying machine includes a housing; a drying compartment assembly including a drum having a drum pressure; a guide apparatus for guiding air in a path; an air moving apparatus for moving air through the guide apparatus; a heating apparatus for heating air moving through the guide apparatus; power means for providing power to components of the dryer including at least the drying compartment assembly, guide apparatus, air moving apparatus, heating apparatus, and control apparatus; a control apparatus for controlling at least one of the drying compartment assembly, the guide apparatus, the air moving apparatus, the heating apparatus, the power means; and, restrictor means for restricting the air flow rate through the guide apparatus entering the drum whereby the drum pressure is more than trivially lower than ambient air pressure.

9 Claims, 9 Drawing Sheets

(56) References Cited

U.S. PATENT DOCUMENTS

| | | | | |
|---|---|---|---|---|
| 4,640,344 | A | 2/1987 | Pravda | |
| 4,730,400 | A * | 3/1988 | Johannsen | 34/380 |
| 4,800,655 | A | 1/1989 | Mori et al. | |
| 5,343,632 | A | 9/1994 | Dinh | |
| 5,442,938 | A | 8/1995 | Kislyuk | |
| 5,443,541 | A | 8/1995 | St. Louis | |
| 5,467,539 | A | 11/1995 | Hahn | |
| 5,713,138 | A * | 2/1998 | Rudd | 34/274 |
| 6,282,919 | B1 | 9/2001 | Rockenfeller et al. | |
| 6,941,680 | B1 | 9/2005 | Zielewicz | |
| 7,188,437 | B2 | 3/2007 | Lee et al. | |
| 7,204,039 | B2 | 4/2007 | Cho et al. | |
| 7,284,709 | B2 | 10/2007 | Guyer | |
| 2004/0123488 | A1 * | 7/2004 | Han | 34/595 |
| 2005/0086827 | A1 * | 4/2005 | Nagae et al. | 34/218 |
| 2005/0217133 | A1 | 10/2005 | Yakumaru | |
| 2006/0218812 | A1 * | 10/2006 | Brown | 34/86 |
| 2006/0254082 | A1 | 11/2006 | Kim | |
| 2007/0006479 | A1 | 1/2007 | Salgado-Mangual | |
| 2008/0196268 | A1 * | 8/2008 | Jung et al. | 34/603 |
| 2009/0255142 | A1 * | 10/2009 | Brown | 34/79 |
| 2011/0099834 | A1 * | 5/2011 | Brown | 34/132 |
| 2012/0227389 | A1 * | 9/2012 | Hinderks | 60/317 |

FOREIGN PATENT DOCUMENTS

| | | | | |
|---|---|---|---|---|
| JP | 02074661 | A * | 3/1990 | D06B 15/09 |
| JP | 02156985 | A * | 6/1990 | D06F 58/22 |
| JP | 08309396 | A * | 11/1996 | C02F 11/12 |
| JP | 11262599 | A * | 9/1999 | D06F 58/02 |

* cited by examiner

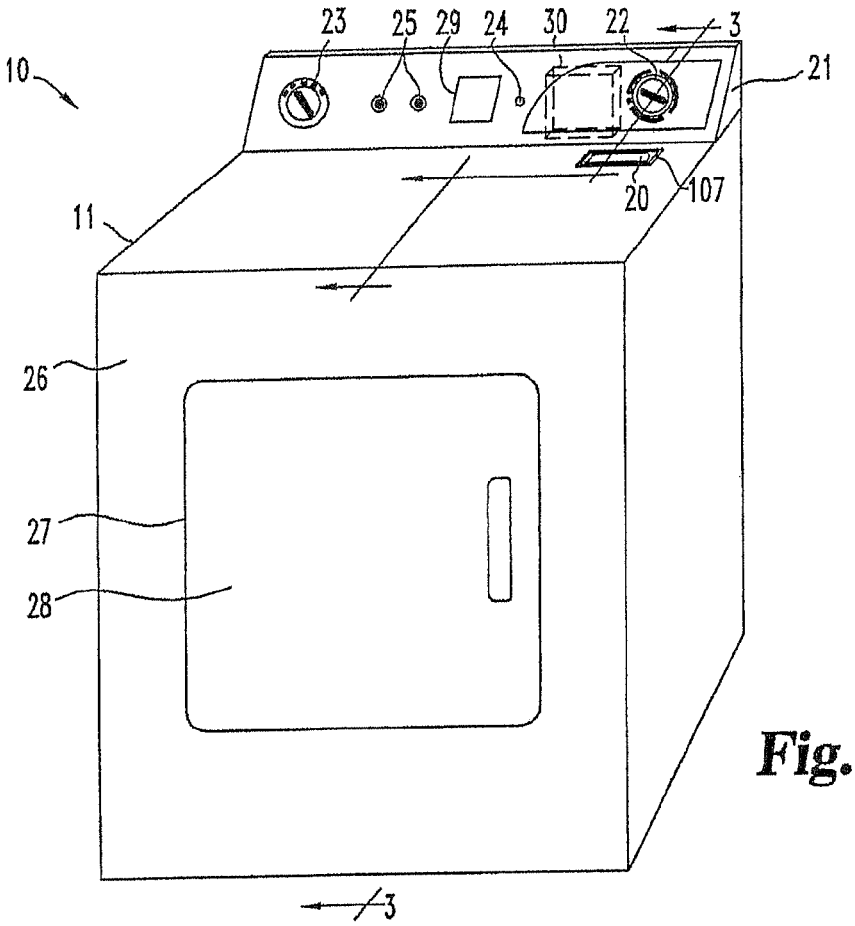
Fig. 1
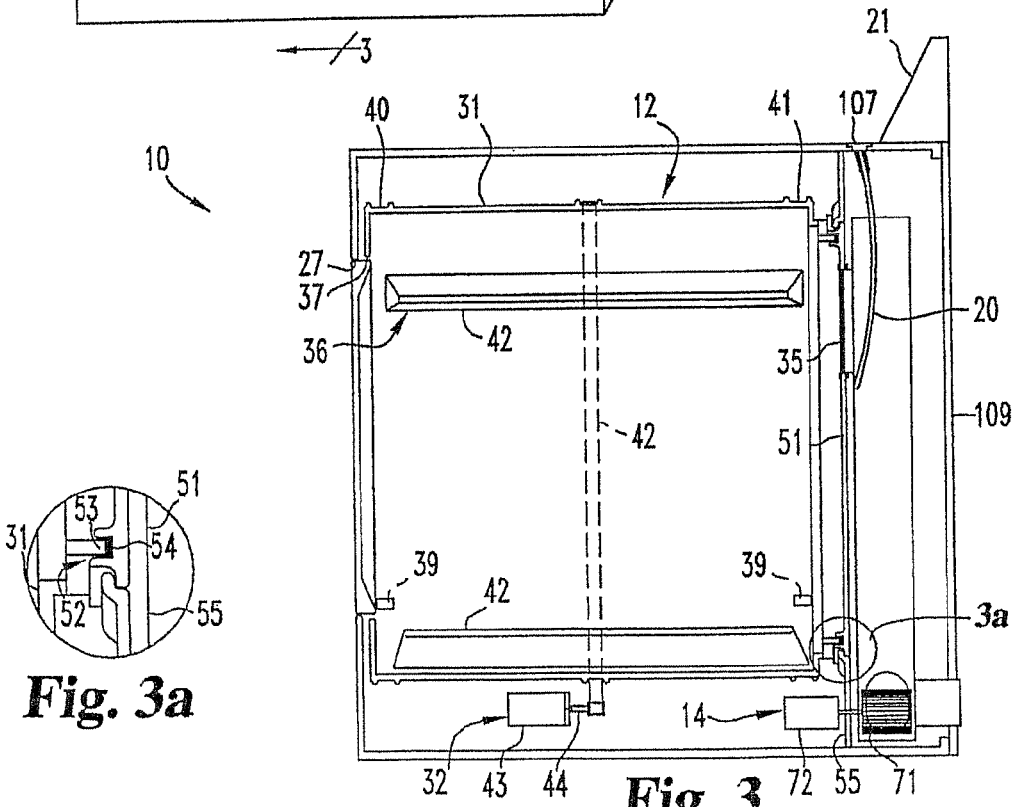
Fig. 3
Fig. 3a

HEAT DELIVERY SYSTEM FOR A FABRIC CARE APPLIANCE

CROSS REFERENCE TO RELATED APPLICATIONS

The present application is a national stage of International Patent Application No. PCT/US2008/74266, filed Aug. 25, 2008 (which was published in English), which is incorporated herein by reference in its entirety, which application claims the benefit of U.S. Provisional Patent Application Ser. No. 60/957,677, filed Aug. 23, 2007 entitled "Heat Delivery System for a Fabric Care Appliance", which is hereby incorporated by reference in its entirety.

FIELD OF THE INVENTION

The present invention relates to drying machines, and in particular, to clothes dryers such as those used in homes, laundromats and other facilities.

BACKGROUND OF THE INVENTION

Fabric care appliances designed to clean articles of clothing include washers and dryers. A typical dryer includes a drum, which receives pre-washed articles of clothing therein. Activation of the dryer causes the drum to rotate while heated air is passed into and out of the drum. The clothes, and more particularly the water content therein, is heated sufficiently to change the water from a liquid to a gas (vaporization), whereupon the water vapor is ejected with the exiting airflow, and the clothes are "dried."

Gas dryers, which use electricity to power various electrically operated components (such as a motor, timer, buzzer alarms, lights, and other "on-board" electrical devices), are labeled as gas dryers because they use gas valves and other gas-related components to allow for heat to be generated for use in the drying process. In contrast, electric dryers do not incorporate any gas components but instead have air-to-air electrical heat resistance element coils allowing for the generation of heat for the drying process.

Despite their popularity, conventional clothes dryers have a number of drawbacks. First among these is that such dryers use significant (many might say excessive) amounts of energy. The average full-sized 240 volt, clothes dryer consumes power on the order of about 4000 to 7000 Watts, such that the clothes dryer typically consumes energy at a higher rate than any other appliance in a home except for the household refrigerator. This is particularly undesirable in the case of conventional gas-powered and electric clothes dryers, given the costs and environmental impact associated with consuming such energy resources.

Further, not only do conventional clothes dryers demand heavy amounts of power, but also such conventional clothes dryers fail to make efficient use of this power. In order to heat articles of clothing for drying purposes, these appliances rely on either a gas-based or electric-based heat source that the U.S. government itself (e.g., the Department of Energy) apparently does not consider to be particularly energy efficient. Indeed, clothes dryers are so inefficient that no clothes dryer on the market is currently listed as qualifying for the U.S. Government's Energy Star rating (see www.energystar.gov).

The poor efficiency of conventional clothes dryers is largely due to the fact that clothes dryers simply do not use large amounts of the energy that is input to the dryers. Most conventional clothes dryers operate by passing dry, heated air around and through the clothes being dried, such that the clothes are heated up and moisture within the clothes evaporates. The heated, moist air is then exhausted out of the dryer and out into the environment (typically, outside the facility housing the dryer). Given this design, clothes dryers continuously expel, as waste, large amounts of heat energy during operation and, indeed, much of the heated air that is directed toward clothes during operation of the dryer simply passes by the clothes and is vented out of the machine without ever contributing to the drying of the clothes.

Clothes dryers also waste heat energy in other ways. For example, much of the heat generated by clothes dryers simply escapes from the dryers due to some combination of radiation, conduction, and convection before the heat ever reaches the clothes. Further, even to the extent that the heat generated by a clothes dryer reaches and heats the clothes, the energy still is often wasted. In particular, once the clothes drying cycle has been completed, the heat energy stored in the clothes further is wasted, as the clothes sit idle within the clothes dryer. Thus, clothes dryers not only require undesirably large amounts of energy in order to operate, but also waste significant portions of that energy.

What is needed is a clothes drying machine that uses less energy and/or is more energy efficient than conventional clothes drying machines, while still providing similar drying capabilities (e.g. while still drying significant amounts of clothes in comparable amounts of time).

SUMMARY OF THE INVENTION

A drying machine includes a housing; a drying compartment assembly including a drum having a drum pressure; a guide apparatus for guiding air in a path; an air moving apparatus for moving air through the guide apparatus; a heating apparatus for heating air moving through the guide apparatus; power means for providing power to components of the dryer including at least the drying compartment assembly, guide apparatus, air moving apparatus, heating apparatus, and control apparatus; a control apparatus for controlling at least one of the drying compartment assembly, the guide apparatus, the air moving apparatus, the heating apparatus, the power means; and, restrictor means for restricting the air flow rate through the guide apparatus entering the drum whereby the drum pressure is more than trivially lower than ambient air pressure.

It is an object of the present invention to provide an improved device for drying clothing.

Further objects and advantages of the present invention will become apparent from the following description of the preferred embodiment.

BRIEF DESCRIPTION OF THE DRAWINGS

FIG. 1 is a front, perspective view of a hydronic clothes dryer 10 in accordance with one embodiment of the present invention.

FIG. 3 is a side view of the hydronic clothes dryer 10 of FIG. 1 taken along the lines 3-3 and viewed in the direction of the arrows.

FIG. 3*a* is an enlarged view of the drum 31 seated in back plate 51 of clothes dryer 10 of FIG. 3.

DESCRIPTION OF THE PREFERRED EMBODIMENT

Figure 2:
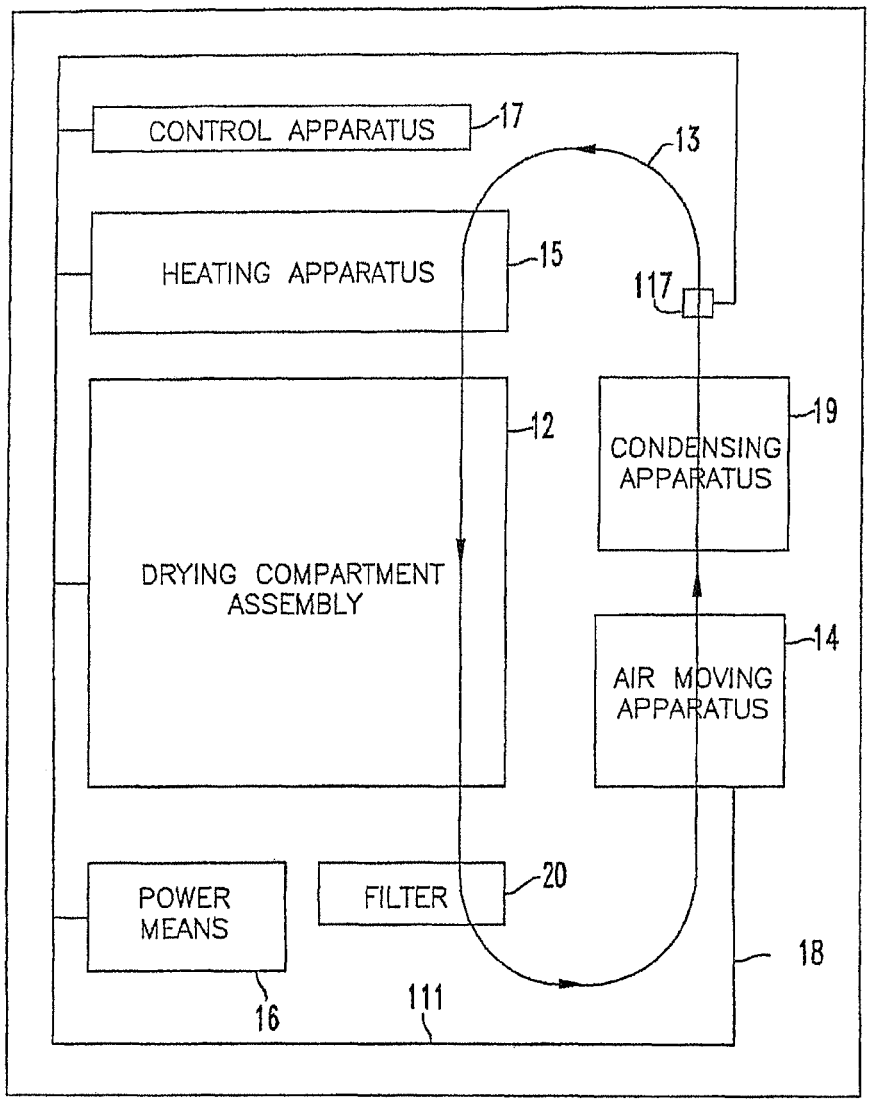
FIG. 2 is a schematic diagram showing the components of hydronic clothes dryer 10 of FIG. 1.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Referring to FIGS. 1-3, there is shown an apparatus for drying clothes, also referred to herein as a drying machine and a clothes dryer 10, in accordance with one embodiment of the present invention. The present embodiment is directed to drying articles of clothing, however it should be understood that use of the word clothing in this regard is intended to cover any and all items that would be appropriate to put in a clothes dryer, such as and without limitation, blankets, curtains, sheets, bedspreads, any items made in whole or in part of a fabric, etc. Clothes dryer 10 can be termed a "hydronic clothes dryer" since, as discussed in more detail below, clothes dryer 10 uses heated water (or any other appropriate heated fluid) to dry clothes placed within the dryer. Clothes dryer 10 generally includes a housing 11; a drying compartment assembly 12; a guide apparatus 13 for guiding air in a path; an air moving apparatus 14 for moving air through guide apparatus 13; a heating apparatus 15 for heating air moving through guide apparatus 13; power means 16 for providing power via suitable wiring 18 to the drying compartment assembly 12, guide apparatus 13 (as necessary, such as at valves 133 and 134, discussed herein), air moving apparatus 14, heating apparatus 15, control apparatus 17, and any other component of dryer 10 needing power; and, a control apparatus 17 for controlling any or all of the drying compartment assembly 12, guide apparatus 13, air moving apparatus 14, heating apparatus 15, power means 16, and any other component of dryer 10 to be controlled, all via wiring 18. Dryer 10 may also include other elements including, but not limited to, a condensing apparatus 19 for removing moisture from air moving through guide apparatus 13 and one or more filter elements 20. The internal components 12-17, 19 and 20 of clothes dryer 10 shown in FIG. 2 are understood to be arranged within dryer housing 11 in any appropriate configuration as may be necessary and/or desired to optimize spatial and operational considerations depending on the particular use for which the dryer 10 is intended, such design and layout considerations being well known to persons skilled in the art.

Housing 11 has a generally box-like shape and is made of any appropriate material for housing the components described herein including, but not limited to, sheet metal, aluminum, or plastic. Housing 11 is intended to also include a variety of other elements connected and/or contained therein or thereto, including, but not limited to, brackets, screws, damping elements, wires, and leveling feet, such as are necessary and/or desired to facilitate the smooth, quiet and reliable operation of a clothes dryer. Such elements are well known in the art and are otherwise omitted from further discussion and illustration. Other applications for the present invention may suggest or dictate other materials be used for the housing and/or any of the other components of dryer 10. For example, and without limitation, a dryer 10 intended for use in a heavy commercial application may include a housing and/or other components thereof that are made of a high strength steel alloy, or a dryer for use in a marine application may have the housing and other components made of a corrosion-resistant materials, such as and without limitation, stainless steel.

Clothes dryer 10 also includes a control panel 21 located at the top of housing 11, control panel 21 holding the majority of elements of control apparatus 17, as is common with many conventional dryers. Control apparatus 17 includes such controls (as at 22 and 23) as are necessary and desired to enable a user to select the various options for operation of dryer 10 as are provided thereby and include, but are not limited to, one or more dials, pushbuttons, touch screens and/or microphones (24), the microphone(s) being operationally coupled with a computer (30) having voice recognition software to enable dryer 10 to be voice controlled. Control apparatus 17 is also contemplated to include one or more indicator elements (such as at 25) as are necessary and/or desired to provide the user with information about the state of operation of dryer 10. Such indicator elements include, but are not limited to, one or more lights, LED readouts, audio speakers, and/or visual displays, the latter including, for example, an LCD display screen 29, such elements to control the dryer cycle, to function as a pump indicator light to indicate when the pump is operational or exhibits a defect; a point-of-use indicator light to indicate that the heater is working properly and a timer selection dial 22. Other controls are contemplated, as well. For example, in the embodiment of FIG. 1, the controls and indicators at 22, 23, 24, 25 and 29 include a pump indicator light that indicates when the pump 74 is operational, a point-of-use heater indicator light that indicates when the point-of-use heater 76 is operating to heat water (or whatever fluid is contained therein), and a timer selector dial that allows a user to determine a time of operation of the dryer and a heat setting of the dryer. Depending upon the embodiment other controls and indicators in addition to, or instead of, those shown can be implemented. For example, in the case of the clothes dryer 170 shown in FIG. 15 that employs water heated by solar energy, the dryer 170 could have an indicator indicating when solar heated water is being received at the dryer 170 from the solar heating system 171. The computer 30 constitutes a component of control apparatus 17 and is operationally connected with the various controls and indicators for processing user input, providing appropriate operational information at the indicators and sending and receiving electronic instructions and information to the various connected components of dryer 10, that is, to and from drying compartment assembly 12, guide apparatus 13, air moving apparatus 14, heating apparatus 15, power means 16, condensing apparatus 19 and filter elements 20, as appropriate. Alternative embodiments contemplate control apparatus 17 being located at other places on and/or in housing 11 or exteriorly of housing 11. For example, and without limitation, instead of a top standing control panel 21, some or all of the control apparatus 17 may be positioned just inside of housing 11, at the top, front or top-front corner of housing 11, and housing 11 would be provided with one or more appropriately sized opening(s) to access control apparatus 17. Alternatively, control apparatus 17 may be positioned in its own panel located remotely from housing 11, for example and without limitation, inset in a wall proximal housing 11.

Figure 5:
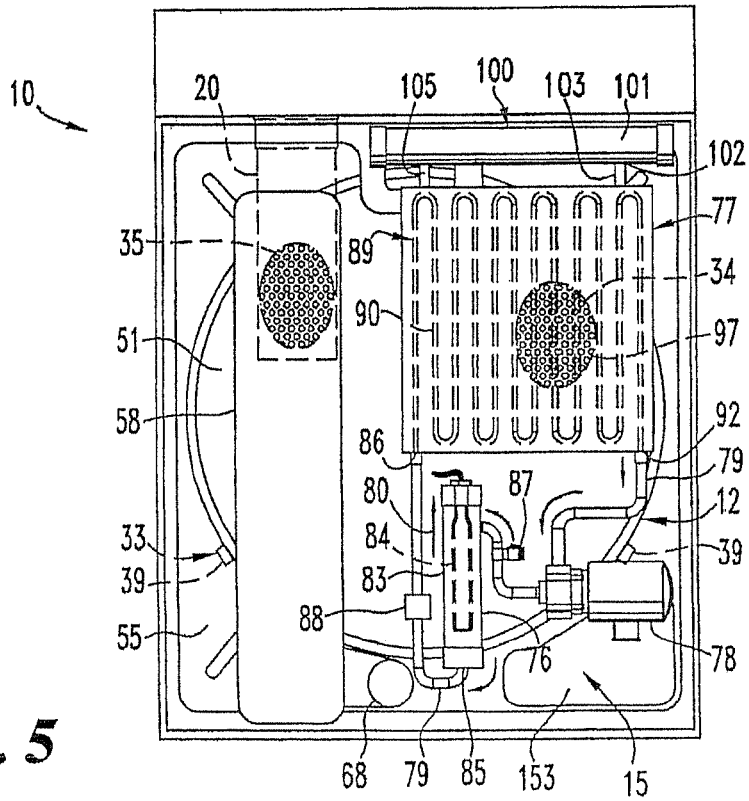
FIG. 5 is a rear, elevational view of clothes dryer 10 of FIG. 1, with the rear panel 109 removed to reveal internal components of dryer 10.

Housing 11 also defines an opening 27 in the front side panel 26 to provide access to the clothes drying drum 31 (FIG. 3) of drying compartment assembly 12 and includes a door 28 hingedly connected to front side panel 26 to close off opening 27 and drum 31. Alternative embodiments contemplate opening 27 and its door 28 being located at any other convenient or desired position in housing 11. For example and with limitation, alternative embodiments contemplate opening 27 and door 28 being located at the top of housing 11, with drum 31 being defined as having an upwardly facing opening. Alternative embodiments contemplate dryer 10 implemented as a combination washer/dryer machine wherein dryer 10 is situated above, below or alongside a washer and operates substantially independently of or in combination therewith. For example, and without limitation, and as described additionally herein, dryer 10 could be configured to share one or more components with a washer that is located proximal thereto and shares some or none of the housing elements therewith. Also for example, and without limitation, a combination washer and dryer incorporating the present invention is contemplated to have a single drum (such as 31), with an opening therein facing horizontally or vertically or at some angle between horizontal and vertical, and with appropriate valving and tubing provided to guide clothes-drying air to such drum during the drying phase thereof. Referring to FIGS. 2, 3 and 5, drying compartment assembly 12 generally includes a drum 31, drive apparatus 32 for rotating drum 31 and support apparatus 33 for supporting drum 31 in position as it is rotated. Drum 31 is typically cylindrical, defines air inlet and outlet openings 34 and 35, respectively, through which can pass the air moving through guide apparatus 13, and some sort of agitation apparatus 36 for tumbling and mixing clothes contained within drum 31 as it rotates. Drum 31 also defines an opening 37 through which clothes can be inserted and withdrawn from drum 31, and drum 31 is mounted within housing 11 such that opening 37 aligns with opening 27 of housing 11. Support apparatus 33 includes any appropriate and known apparatus for supporting a rotating drum within a dryer, such as four nylon guides or rollers, the relative positionment of which is shown at 39. Such rollers are held by brackets (not shown) connected with housing 11 or other appropriate means, and drum 31 defines front and back circumferential channels 40 and 41, respectively, to seat drum 31 for rotation about its axis and upon the nylon guides 39. Agitation apparatus 36 includes one or more inwardly extending fins 42 or any other structure operable as drum 31 rotates to facilitate mixing and tumbling of clothes located therein.

Drive apparatus 32 includes any appropriate and known apparatus for rotating drum 31 on or within its support apparatus, such as a motor 43 with an output shaft 44 that drives a belt 45 that surrounds shaft 42 and drum 31, substantially as shown. Other means as are known in the art for supporting and rotating drum 31 are contemplated by the present invention, including but not limited to, those that would support drum 31 to rotate about a horizontal axis, a vertical axis or one in between. Alternative embodiments contemplate drum 31 being shaped other than cylindrical. For example, and without limitation, drum 31 could be conically or frustoconically shaped and/or could be mounted for rotation on a spindle coaxially connected therewith. Alternative embodiments contemplate drum 31 being moved other than rotationally such as, and without limitation, either randomly or in a path that is somewhat or entirely predefined, such path being linear, curved or a combination thereof. For example and without limitation, drum 31 may be oriented with its opening facing upwardly and drum 31 may be agitated by any appropriate motivating device in a reciprocal path along a vertical axis. Alternative embodiments contemplate drum 31 being stationery, and having a clothing agitating element contained therein that agitates and mixes the clothes during the drying cycle. Such configuration may be particularly useful in a combination washer/dryer where such agitator is the same for the wash, rinse and drying cycles. Generally, the shape of drum 31 and method and path of agitation of drum 31 and/or clothes contained therein may be varied in almost limitless ways so long as there is an air inlet and outlet to drum 31 in communication with guide apparatus 13.

Figure 4:
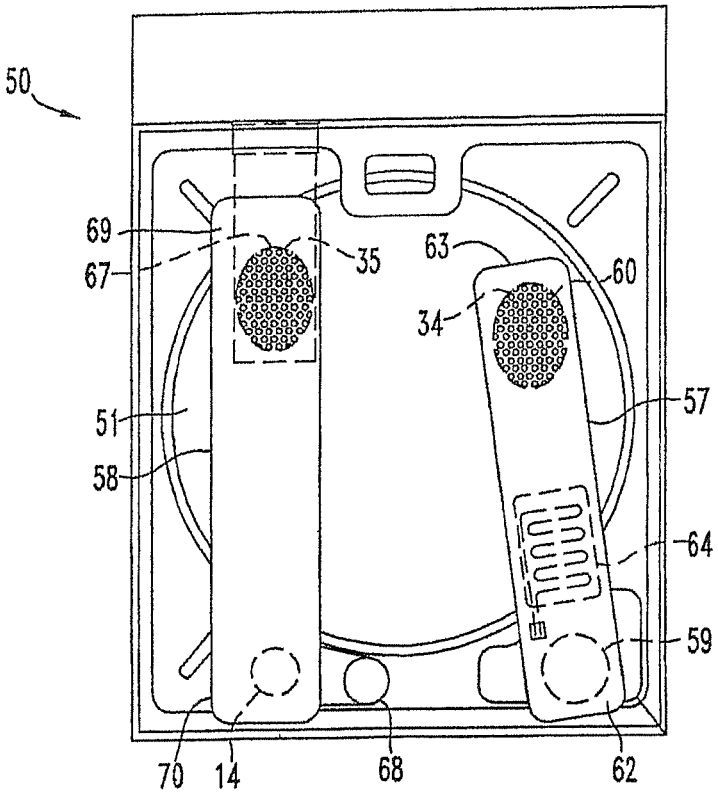
FIG. 4 is a rear, elevational view of a conventional electric clothes dryer 50, with the rear panel 109 removed to reveal internal components of dryer 50.

Thus far, the components of clothes dryer 10, as shown in FIGS. 2 and 5, are not dissimilar from the components of known clothes dryers such as the dryer 50 shown in FIG. 4. In the dryer configurations of FIGS. 4 and 5, drying compartment assembly 12 further includes a stationary back plate 51 that defines a circular channel or recess 52 in which is seated the rearward facing, annular edge 53 of drum 31. An annular nylon, felt or similar appropriate wear ring 54 is interposed between annular edge 53 and back plate 51 to minimize the escape of hot air from within drum 31 and to minimize friction between drum 31 and back plate 51. Back plate 51 is held in place by back panel 55, which is connected with housing 11. Air inlet opening 34 and outlet opening 35 are defined in back plate 51, as shown. As shown in FIG. 4, known dryer 50 and ones like it include a guide apparatus for guiding air in a clothes drying path, the guide apparatus including an inlet guide box 57 and an outlet guide box 58. Inlet guide box 57 defines air inlet and air outlet openings 59 and 60 at its opposing lower and upper ends 62 and 63, respectively. Air inlet opening 59 is open to atmosphere, and air outlet opening 60 is connected in communication with air inlet opening 34 of drum 31. As used herein, atmosphere refers to air and airflow that is outside of dryer housing 11 or is inside dryer housing 11, but is not the subject of structure attempting to prevent it from flowing outside of housing 11 or to guide it to or from a specific location within housing 11. A heating apparatus 64 is located in inlet guide box 57, between air inlet and outlet openings 59 and 60. Dryer 50 is a standard electric dryer where heating apparatus 64 comprises a resistance style heating element powered by electric current. Alternative known dryers are gas dryers, which employ a gas burner that burns natural gas, propane or butane to heat the air moving through inlet guide box 57. In such electric or gas dryers, the size, shape and position of guide box 57 may vary, but its function remains to guide air from an inlet opening, over a heat source to heat the air, and into the clothes drying drum 31.

Outlet guide box 58 is contemplated to be the same in both known dryer 50 and dryer 10 of the present embodiment. Outlet guide box 58 defines air inlet and air outlet openings 67 and 68 at its opposing upper and lower ends 69 and 70, respectively. Air outlet opening 68 is open to atmosphere, and air inlet opening 67 is connected in communication with air outlet opening 35 of drum 31. An air moving apparatus 14 is located in outlet guide box 58, between air inlet and outlet openings 67 and 68. Air moving apparatus 14 is a fan 71 powered by a fan motor 72. Alternative embodiments contemplate a fan placed at any appropriate position on the air inlet side of air guiding apparatus 13, that is, blowing air into the heat exchanger. Such "blowing" fan system would be in place of fan 71 or could be in addition to fan 71. In electric or gas dryers or in the current dryer 10, the size, shape and position of outlet guide box 58 may vary, but its function remains to guide air from an outlet opening 35 of drum 31 and out to atmosphere. Alternative embodiments discussed herein contemplate the guide apparatus largely recirculating the air to withdraw the moisture in a condenser instead of venting it to atmosphere.

In accordance with clothes dryer 10 present invention, the air moving within guide apparatus 13 and through drum 31 of drying compartment assembly 12 is heated by heating apparatus 15, which uses a heated fluid to facilitate heating the air before it is directed into drum 31. Referring to FIGS. 2, 4 and 5, the air inlet guide box 57 and heat apparatus 64 of known dryer 50 are replaced with heating apparatus 15 of the present invention to create clothes dryer 10. A portion of heating apparatus 15 forms a portion of guide apparatus 13, as described below. Generally speaking, heating apparatus 15 is a closed-loop, hydronic heating assembly and includes a hydronic heater 76, a heat exchanger 77, a pump 78, and various tubing 79, as necessary, to interconnect hydronic heater 76, heat exchanger 77 and pump 78 to form a closed-loop, hydronic heater fluid path (indicated by arrows, as at 80) therethrough for a heat transfer fluid contained therein. Hydronic heater 76 includes a heater housing 83, which defines a chamber in which extends electric heating element 84. Via tubing 79, a closed-loop system is provided whereby fluid is pumped from pump 78 to hydronic heater 76 where it is heated by heating element 84, out of hydronic heater 76 (at 85) and to the inlet 86 of heat exchanger 77, through heat exchanger 77 and back to pump 78. Heating apparatus 15 further includes a fluid charging port 87 to fill the closed-loop heating apparatus 15 and includes a temperature sensor 88 located between hydronic heater 76 and heat exchanger 77. Temperature sensor 88 may be located in alternative locations within the closed-loop path, or more than one temperature sensor 88 may be used, to provide temperature readings for any desired location along the closed-loop path. Such temperature information is transmitted (by appropriate connections, not shown) to and incorporated either directly with hydronic heater 76 or with control means 17 to control the heating operation of any of the components of heating apparatus 15. Temperature sensor 88 may be any of any known type suitable for measuring the temperature of a heated liquid flowing through a tube and providing an electronic output readable by a computer and/or displayed on a temperature gauge.

Heating element 84 extends into heater housing 83 to be in communication with the liquid flowing in closed-loop path 80. In response to control apparatus 17, which receives temperature readings from sensor 88 and/or from one or more other sensors located within the path of air in guide apparatus 13, heating element 84 is appropriately activated to heat the liquid flowing in closed-loop path 80 to a particular point-of-use temperature $T_p$, as measured at sensor 88. The point-of-use temperature $T_p$ is contemplated to be between about 125° F. and 250° F. In one embodiment, the point-of-use temperature $T_p$ is preferred to be between about 135° F. and 180° F. In one embodiment, hydronic heater 84 (also an immersion heater) is contemplated to operate at 110 volts and to draw between about 1500 watts and 2000 watts and to maintain a standard rate of clothes drying.

In one embodiment, using a hydronic clothes dryer in accordance with dryer 10 of FIG. 5, such dryer had a drum volume of 7.0 $ft^3$, ran at 1.6 KWH to fully dry pre-washed articles of clothing resulting in a yearly estimated KWH (under current U.S. Government standards) of 1.6 KWH×8 loads per week×52 weeks/year=665.6 KWH/yr. The resulting Energy Factor given by the formula Drying Cycle Factor (an industry constant at 392)×dryer drum $ft^3$ (7.0 $ft^3$)/annual estimated kilowatt usage is =392×7/665.6=4.12 In one other embodiment, also using a dryer 10 in accordance with the present invention, an Energy Factor of 4.2 was achieved. Alternative embodiments contemplate use of immersion heaters drawing fewer volts and/or fewer amps and still providing a high rate of clothes drying. In one embodiment, immersion heater 84 operates to maintain a constant desired point-of-use temperature $T_p$ during the drying cycle. Other embodiments are contemplated wherein the point-of-use temperature $T_p$ may be varied by control means 17. For example and without limitation, the point-of-use temperature $T_p$ may be set to a high value during a drying cycle startup to quickly raise the heat output of heat exchanger 77. The point-of-use temperature $T_p$ may then be reduced (by computer controlled control apparatus 17) to a steady-state value or to variable values suitable to achieve one or more desired clothes drying rates. Such desired rates are contemplated to include ones that are fast (a quick dry cycle), slow (very cost efficient), standard (a compromise between cost efficiency and speed), or otherwise (for example, and without limitation, variable, fluff, delicate, etc.).

Figure 6:
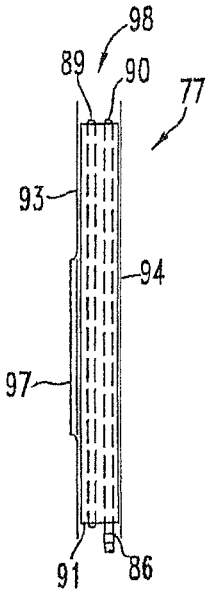
FIG. 6 is a side view of heat exchanger 77 of heating apparatus 15 of clothes dryer 10 of FIG. 1.

Referring to FIGS. 5 and 6, heat exchanger 77 is contemplated to be any suitable heat exchanger operable to provide a high rate of heat transfer from the fluid traveling in closed-loop hydronic fluid path 80 and to the airflow moving in guide path 13. Such heat exchanger 77 includes a finned tubing array 89 having one or more lengths of coiled or snaking copper tubing 90 and a plurality of heat transferring fins. The finned tubing array 89 is connected via tubing 79 at its inlet at 86 to the output of hydronic heater 76, and via tubing 79 at its output at 92 to pump 78. In the embodiment of FIG. 5 (and shown in FIG. 6), heat exchanger 77 includes front and back plates 93 and 94, respectively, between which extends the finned tubing array 89. Front plate 93 defines a flared opening 97 that is sized and shaped to align and engage with the air inlet opening 34 of drum 31. The outer edges 98, around heat exchanger 77 and between plates 93 and 94, are largely or entirely open to permit the free flow of air into the space between plates 93 and 94, over finned tubing array 89, and out through flared opening 97. Alternative embodiments contemplate heat exchanger 77 comprising any suitable size, material and geometric configuration to achieve a high rate of heat exchange and to facilitate the reliable and efficient operation of heating apparatus 15 with its liquid moving through closed-loop path 80. The material selection and configuration of finned tubing array 89 are similar to those contemplated for air conditioner designs and automobile radiator designs.

Pump 78 is any liquid pump suitable and capable of moving water or other heat exchange liquid through the hydronic heater fluid path 80. The fluid moving in hydronic heater fluid path 80 is a liquid and, in one embodiment, is water. Alternative embodiments are contemplated wherein the liquid used for circulation within hydronic heater fluid path 80 is other than water, such as Paratherm NF. Paratherm NF, which is a non-fouling, non-toxic, food friendly liquid commercially available from Paratherm Corporation, 4 Portland Road, West Conshohocken Pa. 19428 USA. Paratherm NF has a specific heat of approximately 0.475 Btu/lb-° F. (compared with a value of about 1.0 Btu/lb-° F. for water), and therefore heats to the point-of-use temperature $T_p$ faster than water. Though water may be referred herein as a primary liquid for use in hydronic heater 76, it is to be understood that all alternative liquids that provide similar and, preferably, superior operating characteristics are contemplated, particularly Paratherm NF, and use of the term water herein is intended to mean water and all such alternatives. Alternative embodiments are contemplated wherein other fluids may be used within heating apparatus 15. For example and without limitation, both water and Paratherm NF are contemplated to stay in a liquid state during the intended operative drying cycle. Alternative embodiments contemplate a fluid that changes between its liquid and gas states during operation. Alternative embodiments are contemplated wherein the liquid used in the hydronic heater fluid path 80 comprises part water and part some non-water liquid, as is used in many automobile radiator systems.

Heating apparatus 15 is also provided with an expansion tank 100 comprising a gas-pressurized closed cylinder 101 with at least one port 102 that is connected via a tube 103 in fluid communication with the tubing 90 of heat exchanger 77. In the event of a momentary blockage or pressure spike in hydronic heater fluid path 80, excess liquid in path 80 can escape into cylinder 101. The gas pressure of cylinder 101 is set at the desired liquid relief pressure of the hydronic heater fluid path 80. Once the pressure spike is relieved, the overflow liquid in cylinder 101 moves through the same tube 103 back into the hydronic heater fluid path 80. Alternative embodiments are contemplated wherein expansion tank 100 is provided with a mechanism, such as with a hydraulic or pneumatic piston, to variably adjust the relief pressure value in expansion tank 100. Alternative embodiments are contemplated wherein port 102 and tube 103 include a one way pressure relief valve (not shown) to function as the inlet to cylinder 101 only when a pressure relief threshold has been exceeded, and cylinder 101 is also provided with an outlet port and tube 105 that has its own one way pressure relief valve (not shown) to permit flow only from cylinder 101 back into hydronic heater fluid path 80 after the pressure spike has been relieved.

Air moving apparatus 14 comprises motorized fan 71, and guide apparatus 13 for guiding air in a path (such path also being designated at 13 in FIG. 2) includes such hoses, fittings and chambers as are necessary and are known in the art for directing air in the desired path. Guide apparatus 13 includes those portions of heat exchanger 77 that permit and direct air from atmosphere around the finned tubing array 89 where it is heated and directed into drum 31. Guide apparatus 13 further includes back plate 51 of drying compartment assembly 12 with its air inlet and outlet openings 34 and 35, and includes outlet guide box 58, which guides the heated air from drum 31 and out air outlet opening 68 to atmosphere.

Figure 7:
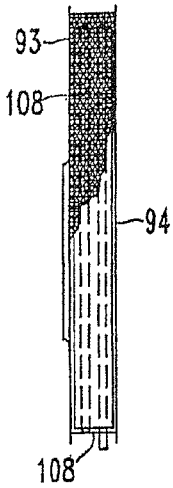
FIG. 7 is a side view of the heat exchanger 77 FIG. 6 and showing a portion of a filter element 51 in accordance with another embodiment of the present invention.

Filter element 20 (FIGS. 1 and 2) is a screen that extends through a slot 107 in the top of dryer housing 11 and across the path of the air in path 13 that exits drum 31 and enters and flows down through the inside of outlet guide box 58. Alternative embodiments are contemplated wherein additional filter elements are provided to catch lint and other debris from entering the air guide path 13. For example, and without limitation, one or more filter elements in the form of a lint screen 108 (FIG. 7) are contemplated to be positioned around heat exchanger 77 to block entry of lint and other particulates into heat exchanger 77. Alternative embodiments contemplate additional filter elements 20 are to be positioned at any desired location along path 13. It is contemplated that the rear panel 109 (FIGS. 3 and 8) of dryer 10 has openings to provide adequate venting of the interior of the dryer. Alternative embodiments are contemplated wherein such openings, as shown at 110 and 111, are provided with filter elements 20, which include screens 112 and 113, as desired, to filter out particulates that can clog any of the internal dryer components, such as heat exchanger 77. Screens 112 and 113 are slidably seated in position over their respective openings 110 and 111 by U-shaped slide brackets 114 and 115, respectively, into which screens 112 and 113 are slidably positioned. Such openings 110 and 111 alternatively could be more or fewer than two, could be positioned on the front, sides, top or bottom of dryer housing 11 and could be any desired shape or size.

Power means 16 is appropriately connected (at 111) with drying compartment assembly 12, guide apparatus 13, air moving apparatus 14, heating apparatus 15, control means 17, condensing apparatus 19, and any other power needing component, to power such elements, as necessary. While typical electric dryers such as dryer 50 require a 220 volt power source, dryer 10 is contemplated to run with comparable or better performance with a 110 power source and to draw considerably less wattage. Generally, power means 16 comprises the necessary wiring and plug to connect with a readily available power source such as and without limitation, a wall outlet providing 110 volts on a 15 amp circuit. Alternative embodiments contemplate power means 16 including some degree of solar power. For example and without limitation, and as discussed in greater detail herein, one or more standard hot water solar panels may be fluidly connected to the hydronic heater fluid path 80 to contribute a substantial amount of heat to the liquid flowing within hydronic heater fluid path 80. By further example, one or more solar photovoltaic panels may be connected with power means 16 to provide some or all of the electric power needed to run clothes dryer 10. Such hot water solar panels and solar photovoltaic panels are well known, and any variation and combination thereof as would facilitate operation of dryer 10 in any desired climate or condition is hereby contemplated to be part of the present invention. Alternative embodiments are contemplated to include any other available energy source capable of providing electricity to the remaining components of dryer 10. Alternative embodiments are also contemplated to provide operation of dryer 10 on less than 110 volts on a 15 amp circuit.

Alternative embodiments are contemplated wherein guide apparatus 13 includes one or more flow diverter valves 117 to direct or moderate air flow therein to achieve a desired flow rate and/or heat transfer rate. For example and without limitation, a valve 117 may be positioned anywhere in the airflow path 13 to the increase airflow rate therein in the event a temperature sensor indicates the temperature inside drum 31 has exceeded a certain value. Such valve 117 is contemplated to be variably openable with a motor element connected therewith to open and close such valve and to be connected with and powered by the power means 16 and to be connected with and controlled by the control apparatus 17. Such valves are well known and readily available.

Figure 9:
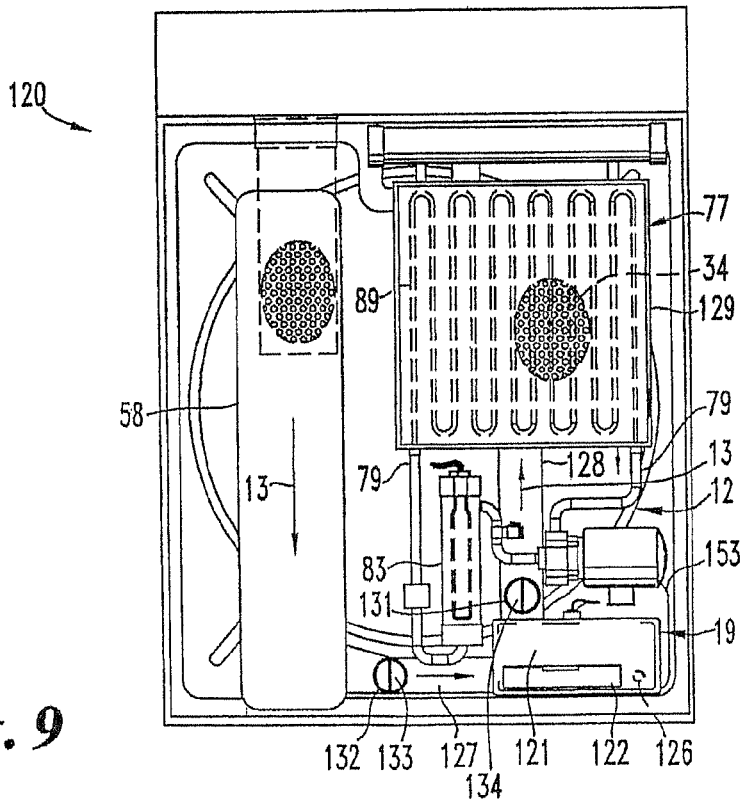
FIG. 9 is a is a rear, elevational view of a clothes dryer 120 in accordance with another embodiment of the present invention, including flow diverter valves to modulate between a closed loop and an open loop airflow circuit and including a condenser unit 121, and with the back panel thereof removed to reveal internal components of dryer 120.

Referring to FIGS. 2 and 9, there is shown a clothes dryer 120 in accordance with another embodiment of the present invention. Dryer 120 is substantially identical to dryer 10 of FIG. 5 except with the addition of condensing apparatus 19, which is serially positioned in the air flow path 13, after drying compartment assembly 12 whereby the moisture-laden air from drying compartment assembly 12 passes through condensing apparatus 19, and moisture is removed therefrom. Such condensing units are well known (such as is found in dehumidifies and the like) and here comprises a powered, self contained condensing unit 121 that has internal, cooling condensing coils filled with a refrigerant (not shown) over which passes warmer, moisture-laden air, such moisture condensing out of the air and being collected in a drip container or pan 122, which must be emptied periodically. Alternatively, instead of a drip pan, a hose or other suitable conduit may be connected at a condensate outlet port (indicated in phantom at 126) to direct the condensate to an exterior drain or collection container (not shown). The embodiment of FIG. 9 constitutes a ventless dryer and its airflow guide means 13 includes a conduit 127 to direct airflow from outlet guide box 58 to condensing unit 121 and includes conduit 128 to direct airflow from condensing unit 121 back to heat exchanger 77. In dryer 120, airflow guide apparatus 13 further includes a shroud 129 or other housing structure positioned around and connected with heat exchanger 77 to channel the airflow from conduit 128 to and around finned tubing 89 and into drum 31. Shroud 129, together with front and back plates 93 and 94, creates a substantially closed box, the only ports for which are the entrance of conduit 128, the exit at flared opening 97, and the entrance and exit tubes 79 of heating apparatus 15. Alternative embodiments contemplate a hybrid ventless dryer whereby airflow guide apparatus 13 further includes an atmosphere air inlet port 131 defined in conduit 128 to provide outside inlet air (atmosphere) to heat exchanger 77, and includes an atmosphere air outlet port 132 defined in conduit 127 to vent the moisture-laden air from outlet guide box 58 to atmosphere. Each of ports 131 and 132 is provided with motor controlled flow diverter valves 133 and 134, respectively, and each valve 133 and 134 is connected with computer controlled control apparatus 17. In operation, in response to data from one or more of moisture content in the airflow path, the condensate level in condenser unit 121, atmosphere air temperature, atmosphere humidity, the temperature of the airflow in path 13, and/or any other data fed to it, control apparatus 17, in accordance with its programming, selectively opens and closes valves 133 and 134 to vary the airflow input and output between a purely closed-loop airflow path and an open-loop airflow path. The latter, open-loop airflow path precludes airflow through condenser unit 121 and all inlet and outlet airflow is to atmosphere. Valves 133 and 134 and their conduits 128 and 127, respectively, are sized and configured to enable selective switching of the airflow therein between complete close-loop (no outside airflow) and complete open-loop (no directed throughput of airflow from outlet guide box 58 to heat exchanger 77). In one embodiment, the computer controlled control apparatus 17 has three preprogrammed settings: ventless (closed-loop with valves 133 and 134 closed, thereby directing airflow in a circuit through condenser unit 121), vented (open-loop with valves 133 and 14 open, thereby directing all airflow to and from atmosphere, excluding condenser unit 121), and partially vented (valves 133 and 134 set to vent 75% of the airflow to atmosphere and to direct 25% of the outlet airflow through condenser unit 121 for moisture removal and thence back into heat exchanger 77).

Figure 16:
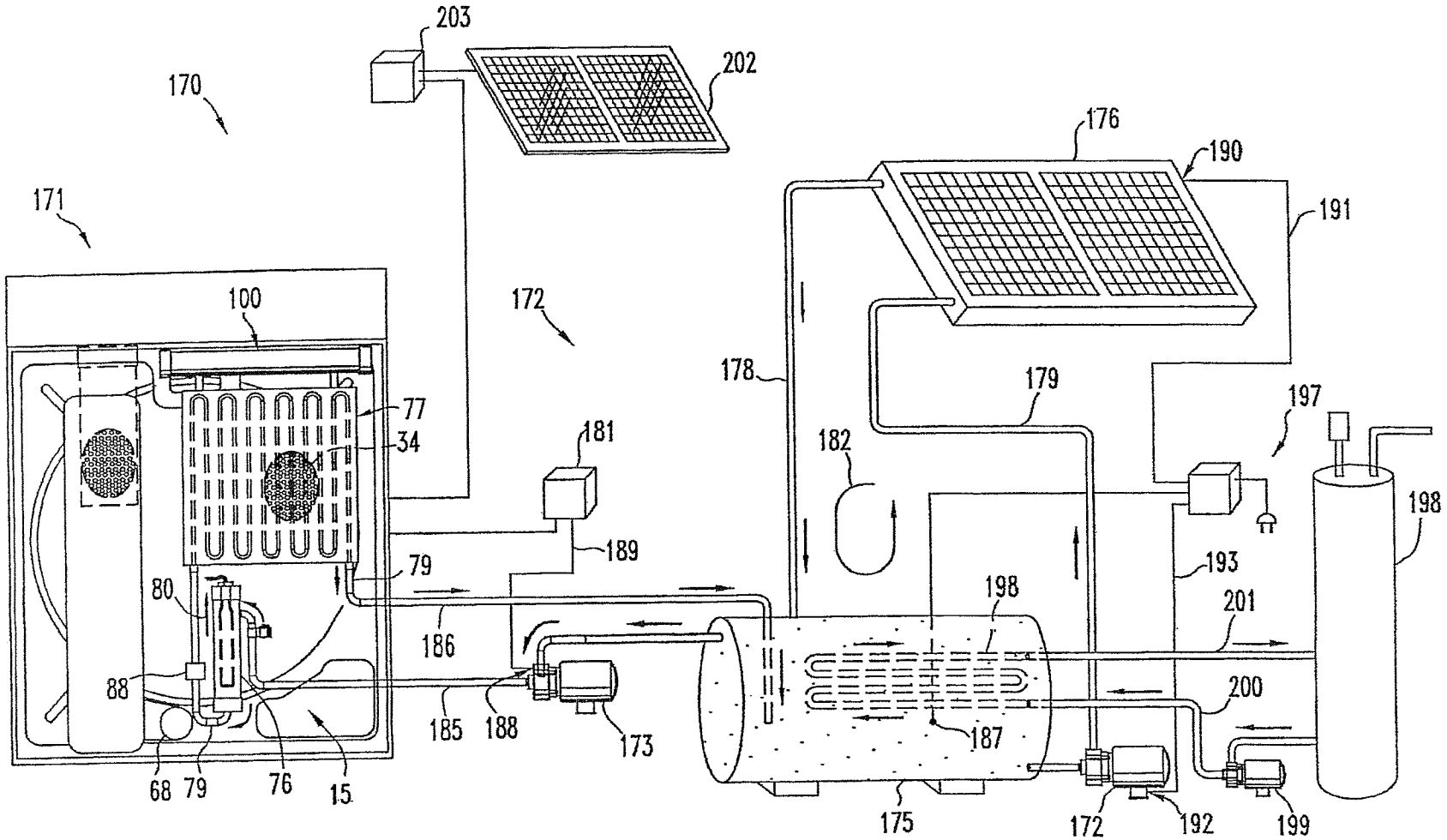
FIG. 16 is a side, partially diagrammatic view of a hydronic clothes drying system 170 in accordance with another embodiment of the present invention.

Referring to FIG. 16, there is shown a clothes dryer 210 in accordance with another embodiment of the present invention. Dryer 210 is substantially identical to dryer 120 of FIG. 9 except with condensing apparatus is not present. Instead, guide apparatus 13 for guiding air in a path includes the conduits 127 and 128, which are joined at 211 to form a continuous conduit direct airflow from the outlet of outlet guide box 58 directly to the airflow inlet 212 of shrouded heat exchanger 77. Absent any escape, the airflow in dryer 210 would endlessly circulate. The atmosphere air inlet and outlet ports 131 and 132 with their motor controlled diverter valves 133 and 134 permit selective diversion of the airflow from the guide path of guide apparatus 13. In the embodiment of dryer 210, one preferred setting is to vent 75% of the air to atmosphere and to direct 25% of the airflow back through heat exchanger 77.

Figure 10:
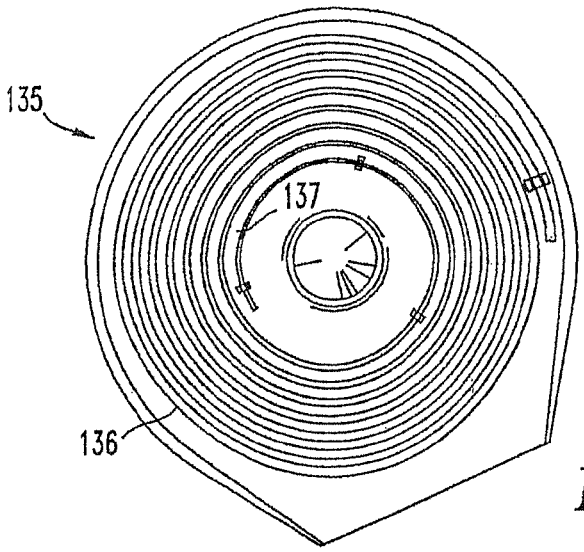
FIG. 10 is a plan view of a coil heat exchanger 135 in accordance with another embodiment of the present invention.
Figure 14:
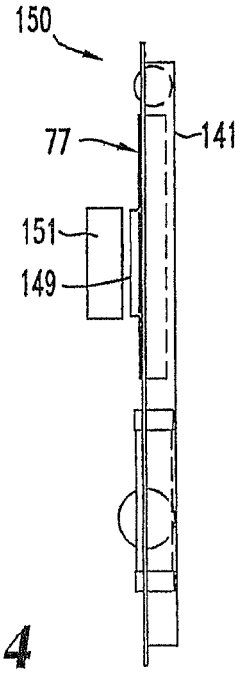
FIG. 14 is a side, elevation view of retrofit kit 150 in accordance with another embodiment of the present invention.

Referring to FIG. 10, alternative embodiments are contemplated wherein heating apparatus 18 includes a heat exchanger 135 having the form of an outwardly spiraling coil 136, as shown in FIG. 10. Coil 136 is tubular and capable of conducting fluid within its interior, and so heated water, or other liquid as disclosed herein, is passed within the interior of coil 136 such that the exterior surface of the coil becomes heated. The air is passed around, along and by the exterior surface of coil 136 (e.g., through the open channel 137 defined between the coil of the spiral), so as to become heated. The heat exchangers described and shown herein are shell and tube type heat exchangers. Alternative embodiments are contemplated wherein the heat exchanger of heating apparatus 15 comprises any one or more of the shell and tube type heat exchanger, a plate heat exchanger, and/or a regenerative heat exchanger.

The hose, tubing and/or other liquid channeling component(s) that form the coil or liquid carrying structure of heat exchanger 77, 135 or other device can be formed from a variety of different materials and have a variety of different characteristics. For example, in some embodiments, the coil could be formed from ⅜" diameter tubing, while in other embodiments the tubing could be anywhere from 5/16" to ¾" in diameter (or a variety of other sizes). Also, in some embodiments, the heating apparatus 15 could include more than one such coil or similar device. For example, the heating device could include two of the coils 135 shown in FIG. 10, one in front of the other.

Depending upon the particular arrangement of the coil or other component(s) within heating apparatus 15, as well as depending upon the level to which the heated water or other liquid is heated, the air passing through the heating device can be heated to varying degrees. Preferably, the surface area available in heating apparatus 15 that interacts with the air is relatively large, to increase the rate of transfer of heat from heating apparatus 15 to the air as it passes along the surface thereof. For this reason, it would typically be preferable to increase the number of loops of tube of coil 135 in the embodiment shown in FIG. 10, as well as preferable to reduce the diameter of the tubing that is used, although the particular embodiment with ⅜" diameter tubing shown in FIG. 10 works adequately well in terms of its ability to heat air passing along and through the coil.

It should also be noted that, in some embodiments (none of which is shown), various air-directing components could be employed in (e.g., as part of) heating apparatus 15 and/or around the heating apparatus that would govern or at least influence the manner of air flow in relation to and through the heating device. For example, in some such embodiments, one or more air vanes or fins could be positioned alongside or even in a manner protruding through the coil 135 or finned tubing array 89, causing air to proceed through the coil 135 or array 89 in a particular manner in relation thereto. Further for example, in some of these embodiments, the air would be directed so as to proceed in a manner that was substantially perpendicular to the plane determined by the coil (e.g., out of the page when viewing FIG. 10).

The Hydronic heater 76, otherwise known as a point-of-use water heater, can be any of a variety of generally small water heaters sized and configured to fit within housing 11 of the clothes dryer 10, such as certain point-of-use water heaters manufactured by the InSinkErator Company of Racine, Wis., for example, the Model W154 4-gallon point-of-use water heater or the Model W152 2½-gallon point-of-use water heater. In the embodiment of FIG. 5, which is intended as a residential dryer, the closed loop path 80 holds less than one gallon of Paratherm NF. It is understood that larger and/or more industrial applications of the present invention would be designed for larger capacity loads, and the closed loop path 80 therefor would be configured to hold a greater amount of liquid, Although the clothes dryer 10 shown in FIG. 2 employs a point-of-use water heater 76 (or heater of other suitable liquid, as described herein) that is internally contained within housing 11 of dryer 10, such that the hydronic heater fluid path 80 is generally contained within dryer 10 (a "tankless" heater), alternate embodiments are contemplated wherein the device(s) used to heat the liquid (and also possibly to pump the liquid) can be positioned externally of the dryer housing 11 and connected with dryer 10 by appropriate components, such as tubing, hoses or other suitable coupling links. A variety of such arrangements involving external heating of the liquid to be provided to heating apparatus 15 are contemplated. For example and without limitation, heated water can be provided from an external hot water heater such as a conventional home hot water heater located away from the dryer or from one or more standard hot water solar panels. Alternative embodiments are also contemplated wherein a bank of dryers 10 would each have an internal heat exchanger 77, but the liquid for each such heat exchanger would be supplied via tubing from a common external tank and hydronic heater. Alternatively, such external common tank dryers could each have its own hydronic heater with just the common tank being external.

Figure 11:
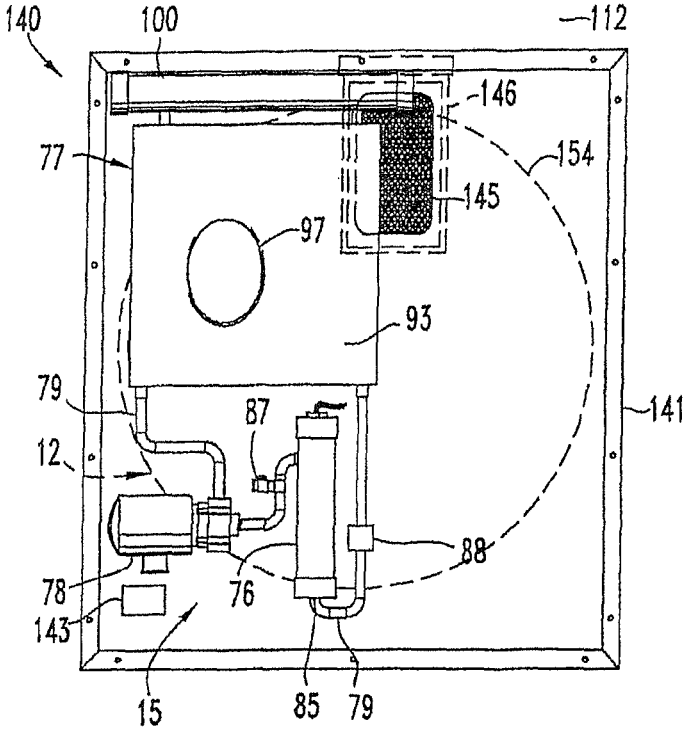
FIG. 11 is front, elevational view of a retrofit kit 140 for modifying an existing dryer 50 in accordance with another embodiment of the present invention.
Figure 12:
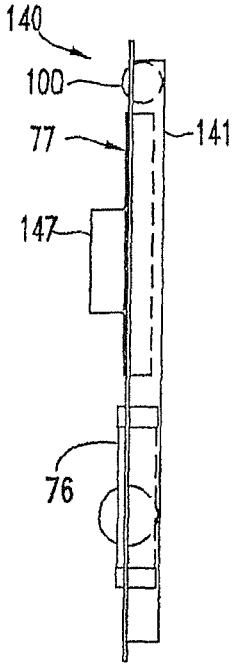
FIG. 12 is a side, elevation view of the retrofit kit 140 of FIG. 11.
Figure 13:
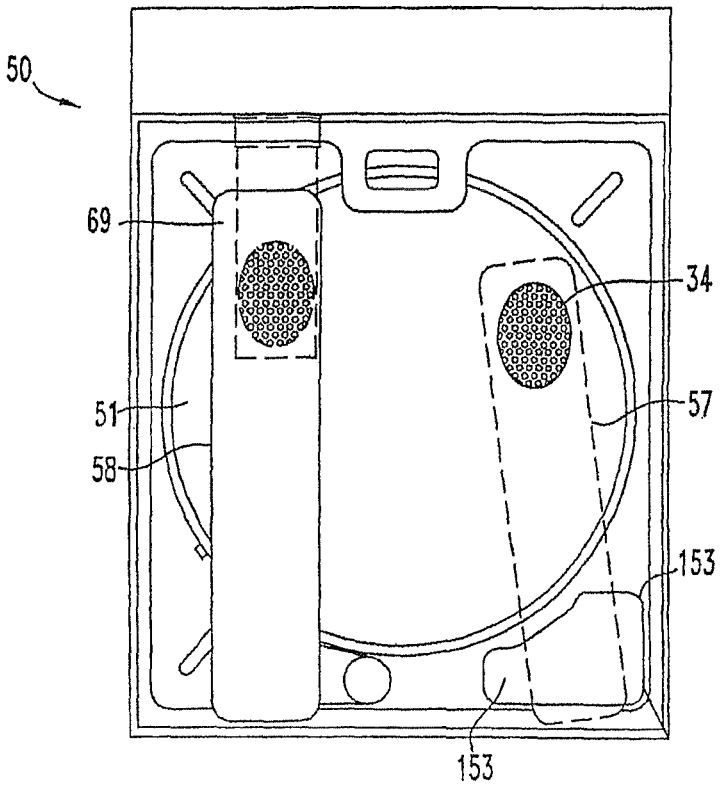
FIG. 13 is a rear, elevational view of conventional electric clothes dryer 50, with the back panel removed to reveal internal components of dryer 50 of FIG. 4, and with components removed in preparation for application of the retrofit kit 140 of FIG. 11.

Clothes dryer 10 of FIG. 5 may be considered to be manufactured in the whole, ready-to-use form and configuration shown and described above. Alternative embodiments are contemplated where a known and existing dryer, such as known dryer 50, is modified to create a dryer like or substantially like hydronic clothes dryer 10. Shown in FIGS. 11 and 12 is a retrofit kit 140 configured for such modification. Retrofit kit 140 essentially comprises a rear housing member 141, heating apparatus 15, retrofit guide apparatus 142 and expansion tank 100, if desired. The relative positionment of the drum 31 of the dryer to be retrofitted is shown in phantom at 154. Retrofit kit 140 also includes such electrical connection elements 143 as are necessary to tap into the electrical system (power means and control apparatus) of the dryer 50 to be modified. For example and without limitation, the hydronic heater 76 of heating apparatus 15 can be powered by a 110 volt power source, but dryer 50 to be modified will likely be configured to run under a 220 volt power source. Nearly all electric dryers run at 220 volts, while. gas dryers typically run at 110 volts. The electrical connection elements 143 of retrofit kit 140 are therefore contemplated to also include an electrical cord and plug configured for a 110 volt outlet, such cord to be switched with the 220 cord of the dryer 50 to be modified. Alternative embodiments are contemplated wherein the retrofit kit 140 includes a self contained condensing unit 121, in which case, the dryer may be left with its 220 volt capability. Alternative embodiments are contemplated wherein the electrical connection elements 143 of retrofit kit 140 includes a step down transformer to permit use of the original dryer's 220 volt cord and plug. Alternative embodiments are contemplated wherein a retrofit kit 140 includes a condensing unit 121 and, in addition, includes a step down transformer wired appropriately to provide the proper 110 volt power supply to hydronic heater 76. Alternative embodiments are contemplated for marine use or use in countries not wired for 110 volt appliances, such dryers 10 and retrofit kits 140, 150 and 156 providing the necessary components and/or transformers to provide proper compatibility therewith. Such electrical connection elements 143 are also contemplated to include any wires necessary to connect the heating element 84, pump 78 and other valves, signals, sensors and other elements as may be included in retrofit kit 140, to the power source and control apparatus of the dryer 50 to be modified. The flared opening 147 of front plate 93 of the heat exchanger 77 of retrofit kit 140 is configured to extend forwardly from front plate 93 a predetermined distance so that, upon installation of retrofit kit 140 to the back of known dryer 50, the forward edge 148 of flared opening 147 will seat against back plate 51, in communication with air inlet opening 34. Different models of known dryer 50 may require such predetermined distance to vary, and flared opening 147 must therefore also vary from one retrofit kit 140 to another. Alternative embodiments contemplate a retrofit kit 150 with a shorter flared opening 149 and an adapter sleeve 151 (FIG. 15) sized and configured to connect shorter flared opening 149 with the air inlet opening 34 of the particular back plate with which the retrofit kit 140 is to be applied. Such adapter sleeve 151 is contemplated to be connected with flared opening 149 in any suitable manner, such as and without limitation, clips, a threaded connection, adhesive, straps, a compression fit, screws, pins, tabs, Velcro®, or tape.

Figure 15:
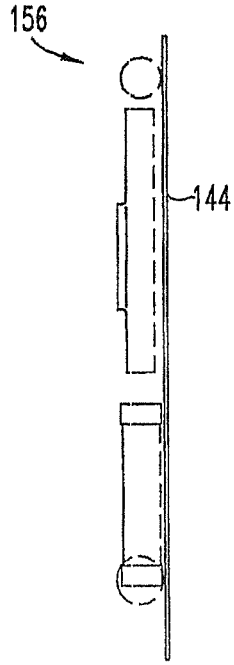
FIG. 15 is a side, elevation view of retrofit kit 156 in accordance with another embodiment of the present invention.

The various operable components and supporting elements of retrofit kit 140—the heating apparatus 15, retrofit guide apparatus 142, expansion tank 100 (if desired), and appropriate electrical connection elements 143—are connected by appropriate means, such as and without limitation, clips, straps, pins, Velcro®, screws, brackets bolts and/or adhesive, to the inside of rear housing member 141 in a manner so that rear housing member 141 can be applied to the rear of the dryer 50 to be modified, and the aforementioned components of retrofit kit 140 will nest properly in a desired place relative to the remaining elements of the original dryer 50. Referring to FIG. 15, alternative embodiments are contemplated wherein the components of the retrofit kit 156 will be made sufficiently small, and/or be configured and arranged to fit within the available space inside of the dryer housing after is has been prepared for retrofitting (for example, partially within recess pocket 153) to enable a rear housing member 144 that has no depth or almost no depth. Such rear housing member 144 would be nearly identical to the dryer's original rear panel 109, and the depth of the resulting retrofitted dryer will therefore not increase. It is also contemplated that rear housing member 141 (or 144, for example) has one or more vent openings, such as at 145, with appropriate filter elements 146, as described with reference to openings 110 and 111 at their screens 112 and 113.

In use, to modify known dryer 50 with retrofit kit 140, with the rear panel 109 of known dryer 50 exposed, the inlet guide box 57 or similar structure and the electrical heat apparatus 64 is removed. In electric dryers, the heat apparatus 64 will typically be located inside of inlet guide box 57, and both guide box 57 and its heat apparatus 64 may be remove as a unit. In gas dryers, the heat apparatus 64 is a gas burner and may be located in or connected to the corresponding inlet guide box 57, and the two may be removed as a unit. Or, the gas heat apparatus 64 may be located in a pocket 153 under drum 31, and it may have to be removed separately. Once inlet guide box 57 and heat apparatus 64 (and their corresponding connections, of course) are removed, the various appropriate electrical connection elements 143 of retrofit kit 140 are connected to the appropriate connection sites in known dryer 50. These will primarily be power source connections. Where known dryer 50 includes a computer controlled control apparatus 17 with basic or sophisticated readouts, user input elements and the capability to receive temperature and other sensor data, such connections are also made. Retrofit kit 140 is contemplated to contain any or all of such sensors as are contained in dryer 10 of FIG. 5 and as may be later known to be included in the dryer to be modified. If not done so at the factory or previously, hydronic heater 76 is charged by filling it with the desired liquid (water, Paratherm NF, or other liquid) at charging port 87. If there is an expansion tank 100, and if it has not been pressurized to the desired pressure, then expansion tank 100 is pressurized, as desired. Fill and drain ports for expansion tank 100 are not shown, but such tanks are well known and the fill and drain ports may be located at any convenient place on such tank. The rear housing member 141 containing the remaining the retrofit kit 140 components—heating apparatus 15, retrofit guide apparatus 142, expansion tank 100 (if desired), and appropriate electrical connection elements 143—is then positioned and aligned against the backside of dryer 50 whereby, either flared opening 147 or the adapter sleeve 151 applied to a shorter flared opening 149, aligns and nests with air inlet opening 34 of back plate 51 and drum 31. Rear housing member 141 is then secured to the housing of dryer 50 by appropriate means, preferably the same screws or other fasteners that previously held the original rear panel 109 of dryer 50 in place. Retrofit kit 140 has now been applied, and modified dryer 50 is otherwise ready for use.

Referring to FIG. 16, there is shown a hydronic clothes drying system 170 in accordance with another embodiment of the present invention. Hydronic clothes drying system 170 includes hydronic clothes dryer 171, solar heating system 172 and pump 173. Hydronic clothes dryer 171 is substantially identical to dryer 10 of FIG. 5, except that the pump (now 173) is moved outside of dryer 171 and a solar pre-heating system 172 is interposed between the output of heat exchanger 77 and pump 173. Solar pre-heating system 172 involves solar heating of the water (or any appropriate liquid, as discussed herein) for use in the heating apparatus 15 of dryer 171. Solar heating system 172 includes a storage tank 175, a bank of hot water solar panels 176, solar drive pump 177, solar panel input and output lines 178 and 179, and a temperature sensor/thermostat 181. Water is pulled by solar drive pump 177 from tank 173 and driven to the bank or array of solar panels 176 where is heated by favorable weather and then returned to tank 175. Via input and output solar pre-heat lines 185 and 186 and pump 173, the solar-heated water from tank 175 circulates in the formerly closed-loop path 80, which is now open to the extent it shares the same circulating water with loop 182 of solar array 176. In optimum weather conditions, such preheating can be sufficient to entirely dry a load of clothes without the need for using the hydronic heater 76. Solar pre-heating system 172 also includes temperature sensors at desired locations such as and without limitation, sensor 187, which measures the water temperature in tank 175, sensor 188 (indicated at the end of lead 189), which measures the water temperature at pump 173, sensor 190 (not shown, but indicated at the end of lead 191), which measures the water temperature in solar panel array 176, and sensor 192 (indicated at the end of lead 193), which measures the temperature at pump 177. The operation of pumps 173 and 177 is contemplated to be controlled, at least in part, based upon the temperature readings from sensors 187, 188, 190 and 192, in addition to any other sensors dryer 171 might have, as discussed herein in relation to dryer 10.

The solar cells of solar panel array 176 only add energy to solar heating system 172 when adequate sunlight is provided to those solar cells. Consequently, the solar heating system 172 may also include an additional heat storage assembly 197 that includes a an auxiliary storage tank 198, a heat exchanger 199 positioned in storage tank 175 and an auxiliary heater pump 199. Connected as shown in FIG. 16, as water in storage tank 175 heats up, pump 199 is activated to circulate the heated water through lines 200 and 201 to increase and maintain the water temperature in tank 198, which is contemplated to be well insulated. When dryer 171 is not in use, storage tank 198 can be maintained at the hottest temperature that can be gained from solar array 176. The heat in such heated water can later be tapped whenever necessary by activating pump 199, either manually or by the computer of dryer 171. All the sensors and motor controls of the elements of solar heating system 172 and heat storage assembly 197 are contemplated to be connected with the computer-controlled control apparatus 17 to facilitate operation of the system and to maximize the energy gain therefrom. Although FIG. 16 shows one embodiment of a solar heating system 172 that is used to provide heated water to a heating device such as the heating apparatus 15 of a clothes dryer such as the clothes dryer 171, this embodiment is intended to be exemplary of a variety of clothes dryer systems that use solar energy, both in whole or in part (e.g., in addition to other sources of energy).

Also shown in FIG. 16 is an array 202 of photovoltaic cells that, while hot water solar panels are absorbing heat energy, array 202 is converting sunlight into electricity that is converted to the proper voltage at converter box 203 and then fed to dryer 171. Operation of dryer 171 is possible at 110 volts under the photovoltaic array, either alone or in combination with the pre-heating assist from solar heating system 172.

Preferably, condensing unit 121 is set at a dew point that is equal to the maximum condensing temperature of the superheated, moisture-laden air passing through condensing unit 121 such that the heated air exiting condensing unit 121 is not substantially lower in temperature than the moist, heated air entering condensing unit 121. That is, preferably, the heat that is absorbed by condensing unit 121 from the moist, heated air is that which is associated with the heating of the moisture within the clothes and changing it from a liquid to a gaseous state.

It is preferred to operate condensing unit 121 so that only a phase change is accomplished (condensation of the moisture in the airflow) without substantially lowering the temperature of the corresponding airflow. Based upon the principles of latent heat contained in a fluid medium or water vapor (e.g., the heated, moisture-laden air emanating from the drum 31), a phase change can occur whereby the water vapor in the airflow is changed to water and its sensible heat (the stored energy released in the phase change from water vapor to water) is deposited directly on the coils of the condenser where the condensation occurred and no heat is lost from the airflow to the coils. By plotting the dew point of a known fluid medium's characteristics via a psychrometric chart, one is able to coordinate resultant measurements, and to thereby optimize moisture removal without substantially reducing the temperature of the corresponding airflow.

In at least some embodiments, the information from the psychrometric chart can be automatically obtained from (e.g., calculated by) the computer 30 of dryer 120 or controller (or other computer-type device, such as a programmable logic device or a microprocessor) that is implemented within the dryer (e.g., implemented within the condensing unit). The data of the psychrometric chart in some embodiments can be stored in a lookup table or other memory device in such computer or similar device, and the condensing unit's coil temperature can be automatically adjusted to accommodate variable changes in temperature as dictated by the changing temperature of the dryer's fluid medium (e.g., air) while circulating through the damp clothing.

For example, when the dryer initially begins its heating or drying cycle, the clothing within the dryer's drum 31 will be substantially cool and saturated with moisture. A dual temperature/moisture sensor that is in communication with computer 30 will monitor the cool air emanating from drum 31. Information is sent by such sensor to the computer 30, which then processes the information and, in turn, automatically adjusts the condensing surface temperature of the coil of condensing unit 121.

As the drying cycle continues, the clothing articles will pick up additional heat, but contain less water vapor. This information is collected by the dual temperature/humidity sensor sensing the hotter, dryer air emanating from the tumbler, and is in turn provided to the computer 30 for processing, which, in turn, will cause a change in temperature of the condensing chamber. The fluid medium (e.g., air emanating from drum 31) continues to be monitored until the temperature/humidity sensor senses that the clothes have reached a moisture level consistent with dried clothing conditions. In some embodiments, the temperature/humidity sensors are manufactured to sense certain levels of "bone-dry mass" contained within the drum 31, and this information is incorporated into the sensor.

In alternate embodiments, a variety of other condensing devices, heat exchangers, or similar devices can be used to perform the function of removing moisture from the moist, heated air emanating from drum 31.

Referring to FIG. 3, at least three electric motors 43 and 72 and one driving pump 78 are used. In a preferred embodiment, motors 43 and 72 are combined, and there would be just one motor driving both fan 71 and belt 42. Further, in certain embodiments, one or more of the channel portions of the air circulation path 13 are insulated to reduce the amount of heat escaping from the air circulation path 13 and thus to conserve energy. In certain embodiments, such insulation could include insulative material or one or more vacuum-sealed (or partially-vacuum sealed) cavities surrounding one or more of the channel portions.

The clothes dryers 10 and 120 and retrofit dryers with kit 140 shown and discussed herein are advantageous in comparison with conventional dryers such as dryer 50 in a number of ways. To begin with, the use of Paratherm NF, heated water, or other liquid to heat the air within the dryer has in tests been shown to be a reasonably efficient manner of heating air. By keeping the water to a reasonably high temperature (e.g., 190 degrees F.) but not too high of a temperature, the amount of heat that is lost from the dryer in the form of radiation/convection/conduction, and not used to heat the clothes, is kept to a lesser level than in many conventional dryers.

With respect to embodiments employing point-of-use water heaters, in particular, the dryer efficiency is enhanced simply because the dryer generates about only as much heat as is necessary to keep the air within the dryer heated to a particular level. In particular, in the case of externally mounted tanks, the hot water is pumped from an external, insulated tank, (2.5 cups from a 2.5 gallon reservoir in the latter case). It is thus possible to continue to provide prolonged heat, even when the point-of-use water heater has reached its pre-set temperature setting and terminated its energy output. This has been demonstrated in tests to result in an effective energy efficiency concept, since the tests have shown that for every 30 minutes of energy required by the point-of-use heater, 30 minutes of heat are generated without the consumption of additional energy by the point-of-use heater.

Additionally, the use of Paratherm NF, heated water (or other fluid) to heat the air within the dryer has in tests been shown to be advantageous in terms of providing improved drying of clothes in terms of the characteristics of the dried clothes. In particular, in contrast to the clothes dried using conventional gas or electric-powered clothes dryers, which often overheat/overdry the clothes, clothes dried through the use of heated water (or other fluid) tends not to be overheated and tends to have a fresh feel and smell without scorching/burning, even without the use of any fabric softeners. Further, the use of heated water (or other fluid) to heat the air tends to further reduce the risk of igniting lint within the dryer and thus tends to enhance dryer safety.

Figure 8:
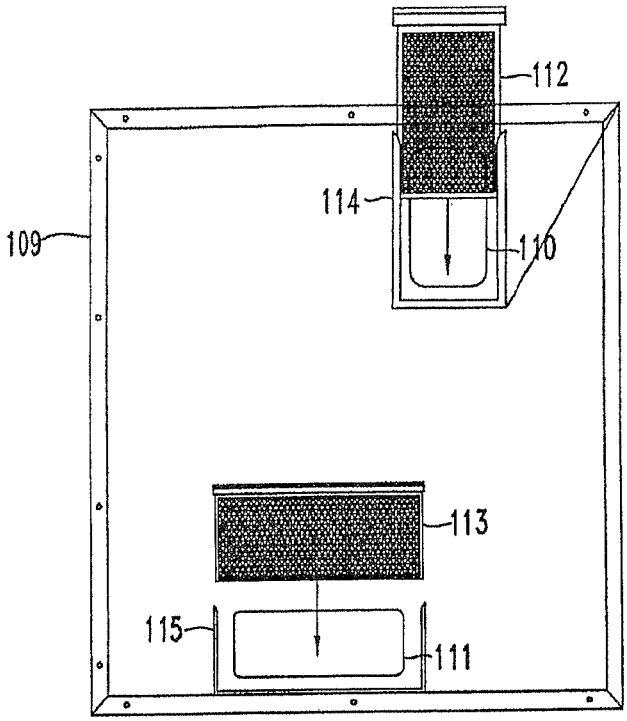
FIG. 8 is a rear view of a rear panel 109 of clothes dryer 10.

Further, in embodiments such as that of FIG. 8 where the heated air is recirculated within the air circulation path, heat is not expelled from the dryer as waste but rather is conserved. Consequently, not much additional energy is required from the point-of-use water heater to keep the heated water hot during operation of the dryer once the air within the dryer has been heated to a normal operational level. Although the embodiments shown in FIGS. 1-16 and discussed herein are intended to be used for drying clothes, the present invention is also applicable to drying machines used for other purposes including the drying of other materials and items other than clothes.

Figure 18:
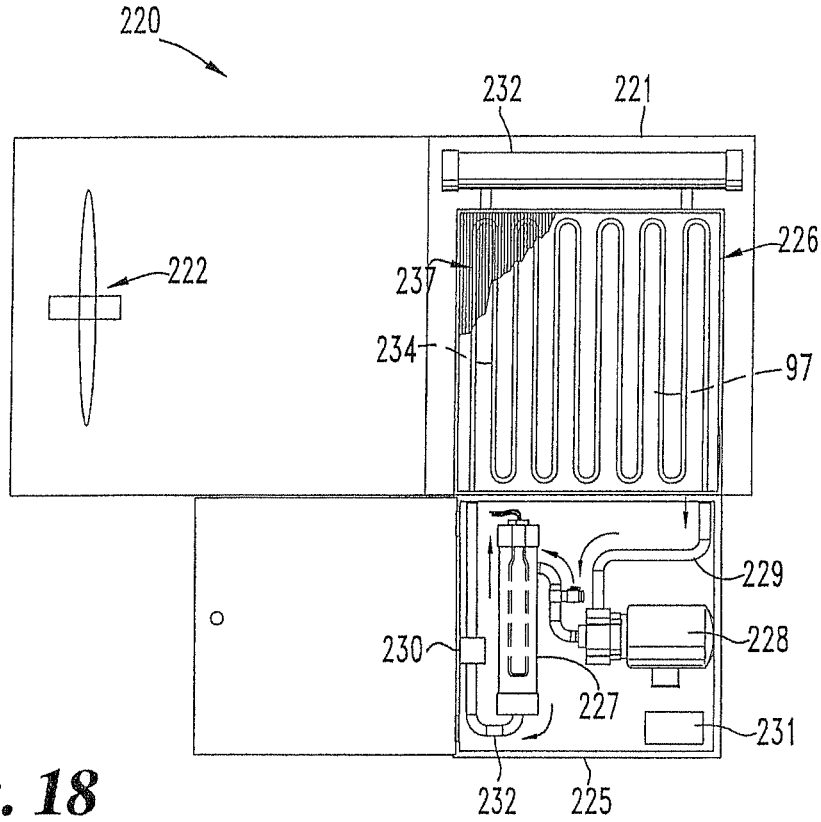
FIG. 18 is a side view of a hydronic furnace retrofit kit 220 in accordance with another embodiment of the present invention.

Referring to FIG. 18, there is shown an alternative application of the present invention in a hydronic furnace retrofit kit 220 suitable for application to an existing furnace having a guide apparatus 221 for guiding air in a path; an air moving apparatus (e.g. a fan blower) 222 for moving air through guide apparatus 221; power means (not shown) for providing power via suitable wiring to any of the other components of the furnace or retrofit kit 220 needing power. Retrofit kit 220 generally comprises a housing 225 configured for partial insertion into the guide apparatus 221 of the furnace; a heat exchanger 226; a hydronic heater 227; a pump 228; tubing 229 creating a closed loop fluid circuit with pump 228, heat exchanger 226, and hydronic heater 227; temperature and/or environmental sensing elements 230: and, a control apparatus 231 for controlling any or all of heat exchanger 226,hydronic heater 227, pump 228, and any other component of furnace retrofit kit 220 to be controlled, all via wiring (not shown). Retrofit kit 220 may also include other elements including, but not limited to, and one or more filter elements (not shown but contemplated to be of the same or similar type as shown and discussed in relation to dryer 10 and 120 and of the heat exchanger of FIG. 7 herein) and or an expansion chamber 232. As with dryers 10 and 120 herein, pump 228 circulates water, or preferably a liquid like Paratherm NF, through tubing 229 into hydronic heater, which heats the liquid, which then travels through tubing 229 into heat exchanger 226. The furnace supplies its own forced air which is heated as it passed over the heat exchanger with its finned coils (coils shown at 234, fins at 237). The liquid returns to pump 228 to continue its circuit.

Also, although it is believed that the manner of operation of the present inventive dryers involving the heating of air through the use of heated fluid enhances the safety of such dryers in comparison with many conventional dryers, this is not intended to constitute a representation that the present inventive dryers will be absolutely safe or that any other dryers will produce unsafe operation. Safety depends on a wide variety of factors outside of the scope of the present invention including, for example, a variety of different design, installation, and maintenance factors. While the present inventive dryers are intended to be highly reliable, all physical systems are susceptible to failure.

An alternative embodiment is contemplated wherein the air pressure within the dryer's drum 31 is substantially reduced to a fixed or modulated pressure during normal dryer operation to correspond to a lower boiling point temperature. A fixed pressure, as used in this application, means the gas pressure in the drum is relatively constant during normal operation. Such pressure could be set at a particular level and left there during the drying cycle, though be changeable if desired, or the components of the dryer 10 could be constructed to create a lower gas pressure inside the drum 31, but where the dryer 10 is not equipped to further modulate such pressure during normal operation. Alternative embodiments are contemplated wherein the gas pressure is dynamic, that is, is capable of modulation and is modulated during the drying cycle to vary the moisture removal rate during its normal operation. The primary purpose of modulating the pressure within the dryer's drum is to change the boiling point of the moisture or water molecules normally contained within prewashed articles of clothing.

The "boiling point" of a liquid is substantially affected by the environmental pressure surrounding the liquid. The environmental pressure is the ambient air pressure surrounding and, typically within, the dryer 10. As an example, pure "water" is known to reach a boiling point of 100° C. (212° F.) under 760 mmHg (29.92 inches) of mercury, but when water is subjected to an "atmospheric pressure" of say, 20.0 inches of mercury, its boiling point temperature is reduced to 89.7° C. (193.63° F.), and at 10.0 inches of mercury, the boiling point temperature is 79.5° C. (175.11° F.). A lower boiling point temperature significantly reduces the amount of thermal energy required for vaporizing the moisture in the clothing placed in a conventional gas or electric clothes dryer. The advantage of using less thermal energy to dry prewashed articles of clothing becomes apparent in many ways and is a desired objective of the present invention.

Conventional clothes dryers vaporize water in moisture-laden clothing by heating the air as it travels through its heater box or air channel, and the heat is then transferred into the confined volume of the drying compartment (the "drum"), which contains the moisture-laden clothing. The air is generally heated by a gas burner assembly (a gas dryer) or an electric resistance heat element (an electric dryer). These heat generating devices are highly susceptible to changes in both the volume of air and its rate of flow (cfm). Too much airflow at higher velocities will create undesirable cooling effects, thus reducing the efficiencies of both the gas and electric dryers. Electric resistance heat elements, subjected to excessive airflow (cfm) will over-cool, causing longer drying times and increased energy consumption. Conversely, if insufficient airflow is passed over the electric resistance coils or through the gas dryer's air channel, the dryer may overheat, reducing element life and potentially causing dryer fires.

Nevertheless, after the air has been heated and as the wet clothing loses its moisture to the heated air through evaporation, both gas and electric dryers will operate more efficiently when increased ventilation or exhausting of the (vaporized) moisture-laden air occurs. Increased air velocities are produced by the dryer's blower/fan assembly. To minimize the negative effects that higher airflow velocities have on conventional gas or electric resistance heat elements, significant airflow must often be redirected around and away from these conventional heating elements, while yet maintaining the optimum maximum flow rate and the dryer's ability to feed air to the blower/fan air intake port for proper exhaust and ventilation of the humidified air stream from inside the drying compartment.

To overcome the internal high/low airflow conflict found in current conventional clothes dryers, dryer cabinets and other components are designed to bypass or redirect a significant portion of the dryer's airflow. This is generally accomplished by intentionally creating air leaks or gaps in the cabinet and other non-sealed areas so that "make-up" air is available to the blower/fan air intake port for its high velocity exhaust, while ensuring the heating apparatuses receive the proper or optimum air flow. The high flow rate of the blower/fan constitutes an off-setting effect for conventional gas and electric dryers, but offers a useful, novel, and superior way to heat and vaporize the water molecules in pre-washed articles of clothing by the development of a cabinet and other components that together decrease the relative pressure inside the dryer's drum via the inherent pressure drop that occurs when airflow passes through a fin-tube heat exchanger of particular density.

Figure 17:
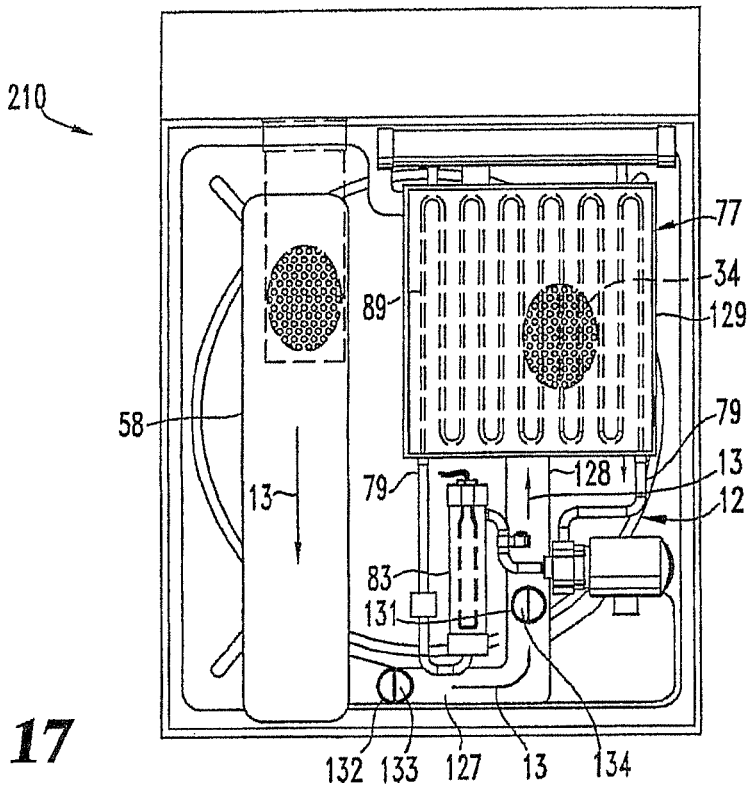
FIG. 17 is a rear, elevational view of a clothes dryer 210 in accordance with another embodiment of the present invention, including flow diverter valves to modulate between a closed loop and an open loop airflow circuit, and with the back panel thereof removed to reveal internal components of dryer 120.

The alternative embodiment contemplated here comprises a modification to the dryer 10 of FIG. 5, or of the dryers 120 or 210 of FIGS. 9 and 17, respectively. More particularly, the present embodiment contemplates restricting the airflow into the air inlet opening 34 sufficiently, in relation to the suction created by fan 71, to lower the gas pressure in the drum 31 during normal operation of the dryer.

In one embodiment of dryer 10, for example, the fin density of heat exchanger 77 is increased to a desired level to create a sufficient level of turbulence in the airflow passing therethrough, which restricts the flow rate therethrough and through opening 34 and, for a particular fan 71, the gas pressure inside drum 31 (the "drum pressure") during normal operation of dryer 10 is decreased. This is a fixed pressure embodiment. The fin density (or other fin configuration parameter) may be selected to provide whatever drum pressure is desired. In one embodiment, a the fin density is selected to cause at least about a five percent reduction in air flow rate through the heat exchanger, and a ten percent reduction in another embodiment. It is noted that the housing or cabinet 11 is uniquely constructed and sealed so that air volume entering drum 31 is solely dependent and controlled by airflow entering drum 31 through air inlet 34, at which is adjacently mounted heat exchanger 77. Heat exchanger 77 is constructed so that the air that passes through opening 34 must pass exclusively through heat exchanger 77, or so that the certain portion of air flow that does pass through heat exchanger 77 is restricted enough to produce the desired drum pressure. The fan/blower assembly 71 is a high velocity device that, in one embodiment, exerts sufficient suction to exhaust up to 2400 cubic feet per minute (cfm), and this high airflow capacity contributes to producing a lower drum pressure in the drum 31 containing moisture-laden articles of clothing. Airflow passively entering the fin-tube heat exchanger 77 enters at approximately 200 cfm is alternately exhausted at a much higher cfm which creates the pressure difference inside drum 31.

It is noted that air pressures may vary somewhat throughout a particular guide apparatus 13 and that the drum pressure may inherently be slightly lower than environmental or ambient pressure in one conventional dryer to another. That is, trivial restrictions to airflow may inherently be produced by the general structure of a dryer 10, such as from inlet screens, inlet covers, air flow guide channels and the like. While these elements may produce a trivial or minute decrease in drum pressure, the present invention contemplates a non-trivial and intentional drop in drum pressure to cause a significant lowering of the boiling point of the moisture in the clothes and, consequently, a significant decrease in the energy required to dry the load of clothes in the drum. While any intentional static and/or dynamic decrease in drum pressure is desired, the decrease in drum pressure is desired to be at least about 3 inches of mercury and preferably greater than 5 inches of mercury. Preferred embodiments decrease the drum pressure as much as possible to commensurately lower the boiling point of the moisture, but not so much as to reduce the ability of the air to receive and carry away the water vapor to the extent of cancelling or defeating the gains made by reducing the boiling point.

In other embodiments, instead of or in addition to the restriction to the flow rate through heat exchanger 77, one or more other elements of guide apparatus 13 or fan 71 may be modified to produce a desired drum pressure. For example, fan 71 may be made to exert a greater suction which, in view of the given structure of guide apparatus 13, may be strong enough to exert a lower drum pressure than with a fan 71 of lower power. Alternatively or in addition, the valve, such as at valve 134 in FIG. 9, is used to restrict airflow into the guide apparatus 13 or the guide apparatus 13 may itself be sized smaller at one or more locations to introduce restriction to the airflow. Any combination of these configurations is intended to create a lower drum pressure, which lowers the boiling point of the moisture in the clothes, which requires less energy to evaporate such moisture. One embodiment contemplates control apparatus 17 modulating the valve(s), such as at 134, and/or modulating the speed of fan 71 to modulate the drum pressure and, consequently, the energy required for drying the clothes and/or the clothes drying rate.

Referring to FIG. 2, air in one embodiment is brought in from the surrounding environment via air moving apparatus 14, and channeled through "optional" condensing apparatus 19, while being modulated via flow diverter valve 117, which is opened and closed electronically by control apparatus 17. Control apparatus 17 includes a barometric sensor positioned inside dryer drum 31 to sense the drum's internal pressure (drum pressure). Control apparatus 17 thus modulates the airflow entering heating apparatus 15 where heat transfer occurs and heated air is delivered into the improved dryer drum 31, in which is created a lower pressure environment, which establishes a lower boiling point and a reduced energy need to heat and vaporize water molecules in the clothes.

It is noted that, in the alternative embodiments, lowering the drum pressure may produce optimal results with the hydronic heating apparatus 15, but apparatus for static or dynamic lowering of the drum pressure can produce substantially improved drying results in conventional dryers that use standard electric or gas heating apparatuses instead of a hydronic heating apparatus.

While the invention has been illustrated and described in detail in the drawings and foregoing description, the same is to be considered as illustrative and not restrictive in character, it being understood that only the preferred embodiment and limited additional embodiments have been shown and described and that all changes and modifications that come within the spirit of the invention are desired to be protected. It is specifically intended that the present invention not be limited to the embodiments and illustrations contained herein, but rather that the invention further include modified forms of those embodiments including portions of those embodiments and other embodiments and combinations of elements of such various embodiments as come within the scope of the following claims.

What is claimed is:

1. A drying machine for drying clothing, comprising:

a housing;

a drying compartment assembly including a drum having an internal drum pressure and being sized and configured to receive moisture-laden clothing;

a guide apparatus for guiding air in a path including through the drum;

an air moving apparatus located after the drum and operable to pull air through said guide apparatus and to only pull air through the drum;

a heating apparatus located before the drum and being for heating air moving through said guide apparatus;

power means for providing power as needed to components of the drying machine including at least said drying compartment assembly, guide apparatus, air moving apparatus, heating apparatus, and control apparatus;

a control apparatus for controlling at least one of said drying compartment assembly, said guide apparatus, said air moving apparatus, said heating apparatus, and said power means; and, restrictor means for restricting the air flow rate through said guide apparatus entering the drum whereby the drum pressure is more than trivially lower than ambient air pressure.

2. The drying machine for drying clothing of claim 1 wherein said heating apparatus includes a heat exchanger having a fin density.

3. The drying machine for drying clothing of claim 2 wherein said restrictor means includes the fin density causing at least about a five percent reduction in air flow rate through the heat exchanger.

4. The drying machine for drying clothing of claim 2 wherein said restrictor means includes the fin density causing at least about a ten percent reduction in air flow rate through the heat exchanger.

5. The drying machine for drying clothing of claim 1 wherein said air moving apparatus includes fan means for moving air through said guide means and wherein said restrictor means includes said fan pulling air through said guide means at a sufficient force to reduce the drum pressure more than trivially below the ambient air pressure.

6. The drying machine for drying clothing of claim 1 wherein said air moving apparatus includes variable fan means for moving air through said guide means and wherein said restrictor means includes said control apparatus variably pulling air through said guide means at sufficient forces to reduce the drum pressure more than trivially below the ambient air pressure.

7. The drying machine for drying clothing of claim 1 wherein said restrictor means includes valve means connected with said guide apparatus to selectively restrict the air flow through said guide means.

8. The drying machine of claim 1 wherein said restrictor means lowers the pressure in the drum at least about 3 inches of mercury.

9. The drying machine of claim 8 wherein said restrictor means lowers the pressure in the drum at least about 5 inches of mercury.

* * * * *